United States Patent [19]

Holkko et al.

[11] 4,173,249

[45] Nov. 6, 1979

[54] EXTENDED NIP PRESS FOR A PAPER MACHINE

[75] Inventors: Seppo Holkko; Jukka Lehtinen; Pekka Majaniemi, all of Tampere, Finland

[73] Assignee: Oy Tampella AB, Tampere, Finland

[21] Appl. No.: 922,393

[22] Filed: Jul. 6, 1978

[30] Foreign Application Priority Data

Jul. 8, 1977 [FI] Finland ..... 772143

[51] Int. Cl.[2] ..... D21F 3/04; D21F 3/06

[52] U.S. Cl. ..... 162/360 R; 100/118; 100/153; 100/154

[58] Field of Search ..... 162/360 R, 358, 305, 162/205; 100/118, 121, 153, 154, 160, 162 R

[56] References Cited

U.S. PATENT DOCUMENTS 3,293,121 12/1966 Martin ..... 162/358

3,804,707 4/1974 Mohr ..... 162/358

3,808,096 4/1974 Busker et al. ..... 162/358

*Primary Examiner*—Richard V. Fisher

*Attorney, Agent, or Firm*—Ladas, Parry, Von Gehr, Goldsmith & Deschamps

[57] ABSTRACT

An extended nip press for a paper machine for removing water from a fiber web carried by a porous felt through a press zone in which the web is subjected to a pressure action. The press comprises press rolls forming at least two separate press nips and a sealing element positioned between the second rolls forming the press nips. The web, the felt and a band supporting the web and felt is passed through the press nips. A pressure medium chamber is limited by that part of the band which extends between the press nips, by the secondary rolls and the sealing element for subjecting the web to the pressure action. The press nips form rolling seals between the secondary rolls and the band.

12 Claims, 8 Drawing Figures

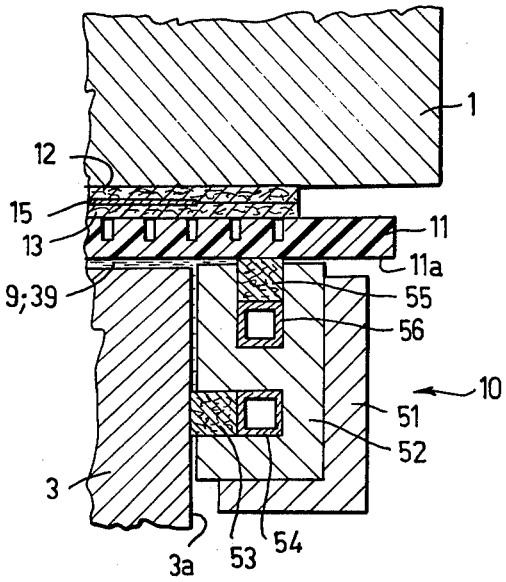
FIG. 5
FIG. 8
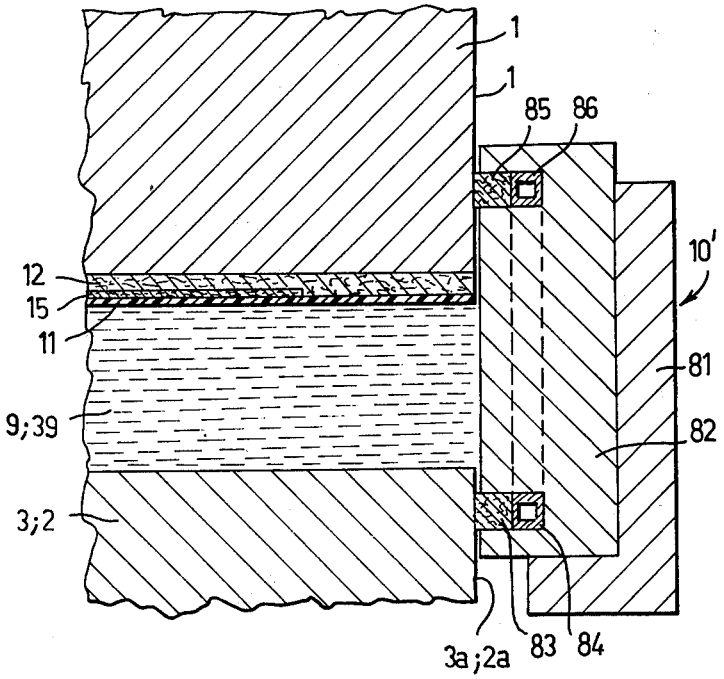

EXTENDED NIP PRESS FOR A PAPER MACHINE

This invention relates to an extended nip press for a paper machine for removing water from a fiber web passing through the press, said press comprising press rolls, a porous felt for conveying the web to be treated into contact with said press rolls, a band which follows the felt and is impermeable to a pressure medium, and a sealed pressure medium chamber positioned between the rolls, which chamber forms a press zone for subjecting the band to a pressure action.

It is earlier known to extend in a press for a paper machine the zone where the web to be treated is pressed against the periphery of a press roll, so that the press zone extends over a substantial distance in the direction of the periphery of said press roll.

In U.S. Pat. No. 3,293,121 it has been suggested to obtain such an extended press zone by arranging in connection with the press roll a chamber which extends over a desired area of the periphery of the roll and which is pressure medium tight except at the open side facing the roll. The edges of the open side of the chamber are sealed against a moving band which is impermeable to pressure medium and follows the periphery of the roll over the press zone. By filling the chamber with a pressure medium, the web which is passed between the roll and said band together with a porous felt can be subjected to a pressing action over the press zone. However, the sealing of the chamber causes substantial difficulties in this construction because the sealing of the chamber against the surface of the press roll is carried out by means of the band, the web and the felt.

In U.S. Pat. No. 3,293,121 it has also been suggested to use as the pressure medium chamber a sealed, elongated sack with flexible walls and filled with a pressure medium. In this U.S. patent it is further suggested that this sack is pressed against the periphery of the press roll by means of a special support roll in order to accomplish an extended press zone. Thereby the sack rolls along the surface of the press roll and is carried by axial support bearings. Even if the sealing difficulties above can be eliminated by using such a sealed sack, there is, however, a considerable disadvantage in that the flexible wall material of the sack limits the inner pressure which the sack can be subjected to. The web to be treated can thus be subjected only to relatively low pressures.

Constructions for extended presses are also known in which the above described sack forming the pressure medium chamber is replaced by a tube formed by an endless, flexible band which is impermeable to pressure medium and the opposite ends of which are sealed by stationary platelike gables. Because such a tube formed by a flexible band expands due to the inner pressure, there are substantial sealing difficulties also in this construction. Also here only relatively low pressures are possible due to the flexible wall material of the tube.

The object of this invention is to obtain an extended nip press in which the above-mentioned disadvantages are eliminated. This object is reached by a press according to the invention wherein there is formed between the press rolls at least two press nips through which the felt, the web and the band pass and wherein the pressure medium chamber is limited in the machine direction by the part of the band positioned between the nips, by the second roll of each nip and by a sealing element arranged between said second rolls.

In the press according to the invention the press zone, which affects the band and is formed by the pressure medium chamber, is sealed in the cross machine direction by means of press nips. The press nips serve as simple and reliable rolling seals. Also the press rolls and the sealing element which together define the pressure medium chamber can be effectively sealed against each other in the cross machine direction because the sealing of the sealing element can be accomplished by glide seals or rolling seals acting directly against the periphery of the press rolls. Gable walls which seal the opposite ends of the pressure medium chamber can be sealed directly against the end surfaces of the press rolls and the sealing element. This also accomplishes a simple and reliable sealing at the ends of the pressure medium chamber. In the construction according to the invention the pressure medium chamber is in all directions limited by firm, i.e. by inflexible and inelastic surfaces. Due to this, a desired operating pressure can be generated in the pressure medium chamber in order to subject the web in the press zone to the necessary pressing action.

In the following the invention will be described in more detail with reference to the accompanying drawings.

FIG. 5 is an enlarged sectional view of the sealing arrangement of the gable wall along line V—V in FIGS. 1 and 3.

FIG. 8 is an enlarged sectional view of an alternative embodiment for the sealing arrangement according to FIG. 5.

Figure 1:
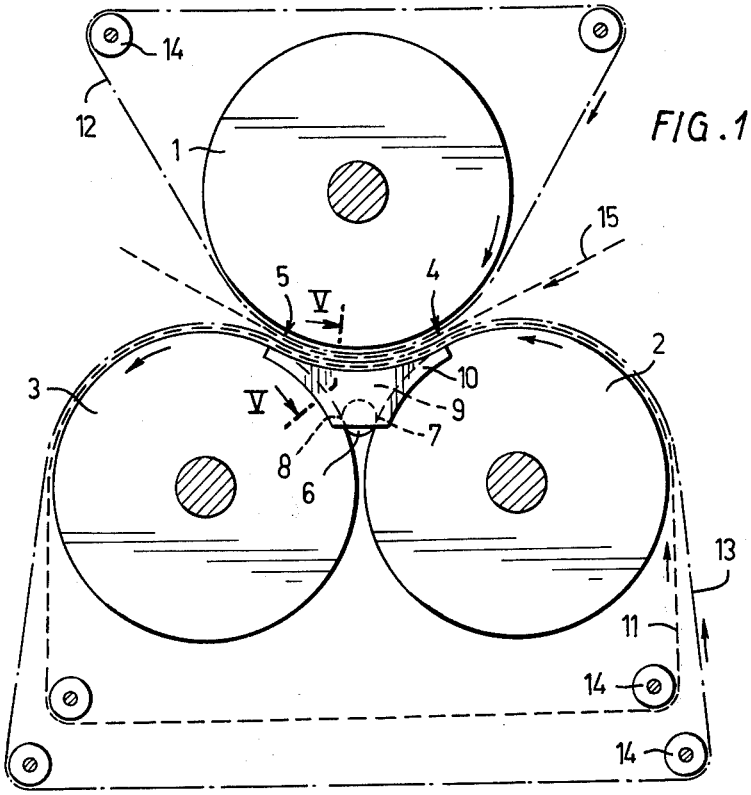
FIG. 1 is a side view of a preferable embodiment of an extended nip press according to the invention.
Figure 2:
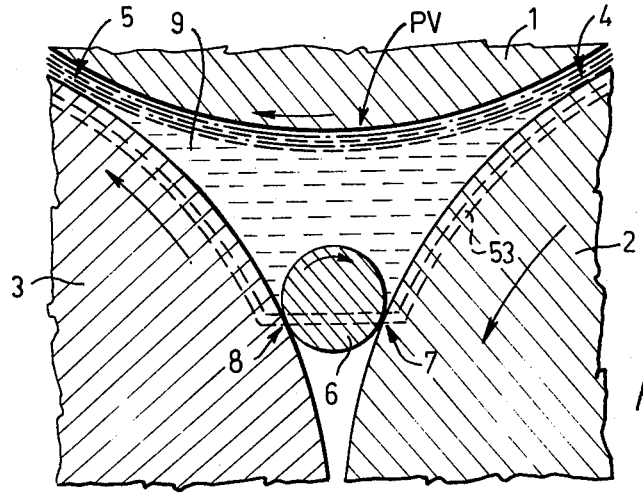
FIG. 2 is an enlarged view of the pressure medium chamber positioned between the rolls.

The extended nip press shown in FIGS. 1 and 2 comprises three press rolls 1,2,3 which are positioned parallel with each other and extend in the transverse direction of the paper machine. The rolls 2 and 3 roll against a common roll 1 and form with said roll two press nips 4,5. At a distance from the roll 1 there is positioned below the roll a seal roll 6 which rolls against both of the rolls 2,3 so that seal nips 7,8 are formed between the rolls. A pressure medium chamber 9 is thus formed between the rolls 1,2,3 and 6, which chamber is in the machine direction limited by the rolls and sealed by said nips. In the cross machine direction the pressure medium chamber is closed at both ends and sealed by gable walls 10, the construction of which will be described later in more detail. The pressure medium chamber is connected with a pressure medium source, not shown, in order to supply the chamber 9 with pressure medium and to generate a desired medium pressure in the chamber 9.

The press comprises also a band 11 impermeable to pressure medium which band passes around the rolls 2,3 and porous felts 12,13. The felt 12 passes around the roll 1 and the felt 13 passes around the rolls 2,3 carried by the band 11. The equipment required for moving the band and the felts is indicated by the reference number 14. The paper web which is passed through the press is indicated by the reference number 15. In this embodiment the band and the felt pass through both press nips 4,5 and in the area between the nips they are pressed against the surface of the press roll 1.

In order to dry the web it is passed between both felts 12,13 through the press. When the band, the felts and the web reach the first nip 4, the web is subjected to normal pressure by the press nip, whereby water is removed from the web into the felts 12,13 due to pressure difference. After passing through the nip the web is still under pressure, because the pressure medium in the chamber 9 subjects the web to a pressing action through the band 11 during the whole distance betwen the nips 4,5. The extended press zone created by the pressure medium is indicated by the reference PV in FIG. 2. At the end of the press zone the band, felts and web pass through the second nip 5, whereafter the web is released from the felts and the felts are passed through conditioning and supporting devices back to the nip 4.

It appears from the Figures that the pressure medium chamber 9 is limited in the machine direction by the band 11 and the peripheries of the rolls 2,3,6, in other words by rigid inflexible surfaces, which makes it possible to generate even high pressures (for example 3 MPa) in the chamber 9. The pressure medium chamber is limited by the nips 4,5 and 7,8 which act as effective rolling seals. The sealing roll 6 is forced towards the rolls 2,3 by means of the pressure medium.

Figure 3:
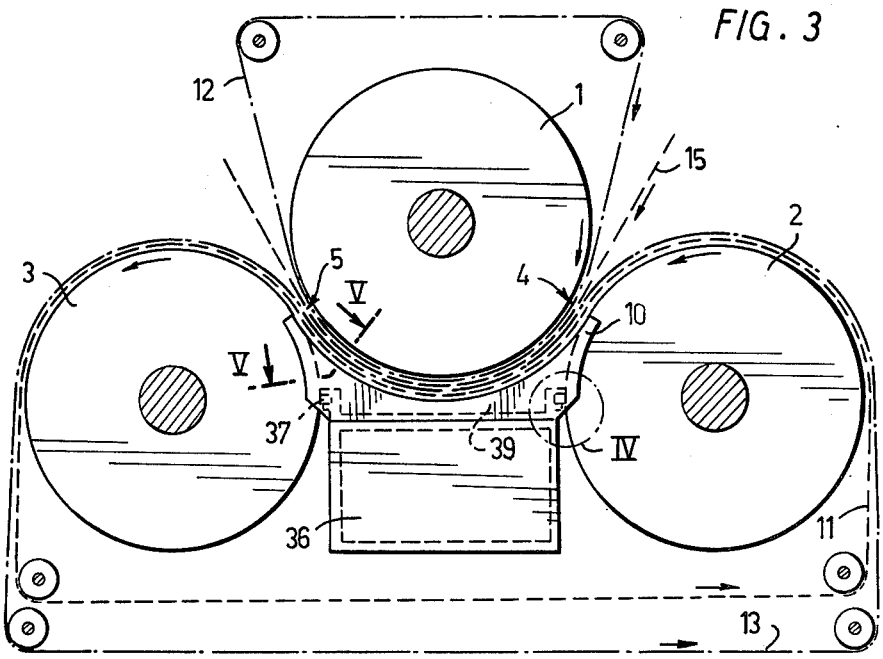
FIG. 3 is a side view of another embodiment of the invention.
Figure 4:
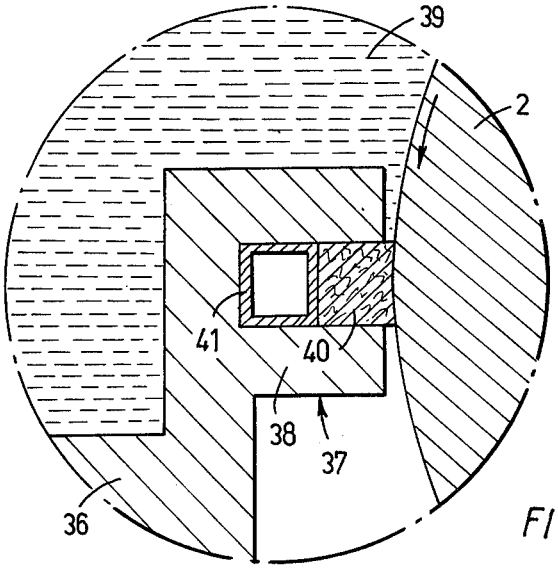
FIG. 4 is an enlarged sectional view of the part IV encircled in FIG. 3.

The embodiment shown in FIGS. 3 and 4 differs from the above-mentioned primarily with respect to the sealing element positioned between the rolls 2,3. The sealing roll 6 has in this embodiment been replaced by a solid or hollow beam 36 which is parallel with the rolls. The beam 36 supports edge seals 37 which are pressed against the peripheries of the adjoining rolls 2,3 and which thus seal the pressure medium chamber 39. According to FIG. 4 the edge seals comprise a holder 38, which is fastened to the beam 36. A sealing strip 40 and a loading member 41 are arranged on the holder 38.

In both the above described embodiments the ends of the pressure medium chamber are sealed by gable walls 10, both of which comprise a platelike gable 51 (FIG. 5) supporting a seal holder 52. A first seal 53 arranged in the holder and affected by a loading member 54 is pressed against the gable surface 3*a* of the press roll 3, and a second seal 55 affected by a loading member 56 is pressed against the lower flat side 11*a* of the edge zone of the band 11. At the seal roll 6 (FIG. 1) and at the seal beam 36 (FIG. 3) the seal 53 of the gable wall is pressed correspondingly against the end surface of the seal roll and the seal beam respectively. The sealing of the gable is thus simple and reliable.

Figure 6:
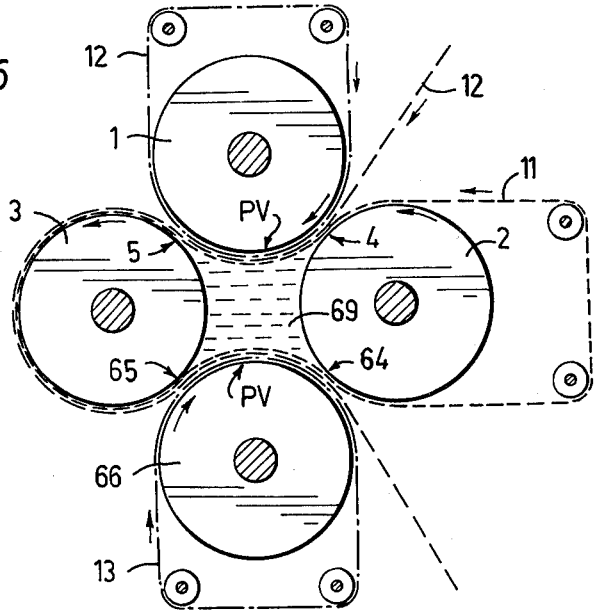
FIGS. 6 and 7 are side views of two further embodiments of the press.

The embodiment of the press shown in FIG. 6 corresponds essentially to the press according to FIG. 1. In FIG. 6 the seal roll 6 has been replaced by a similar press roll 66 as the press rolls 1,2,3 so that the rolls 2 and 66 and also the rolls 3 and 66 form between them normal press nips 64 and 65 respectively. The rolls define between them a pressure medium chamber 69 sealed by said nips. Thus the band 11 and the web 15 pass also through the nips 64,65 and around the press roll 2, on its outside. The press forms two press zones PV affecting the web.

Figure 7:
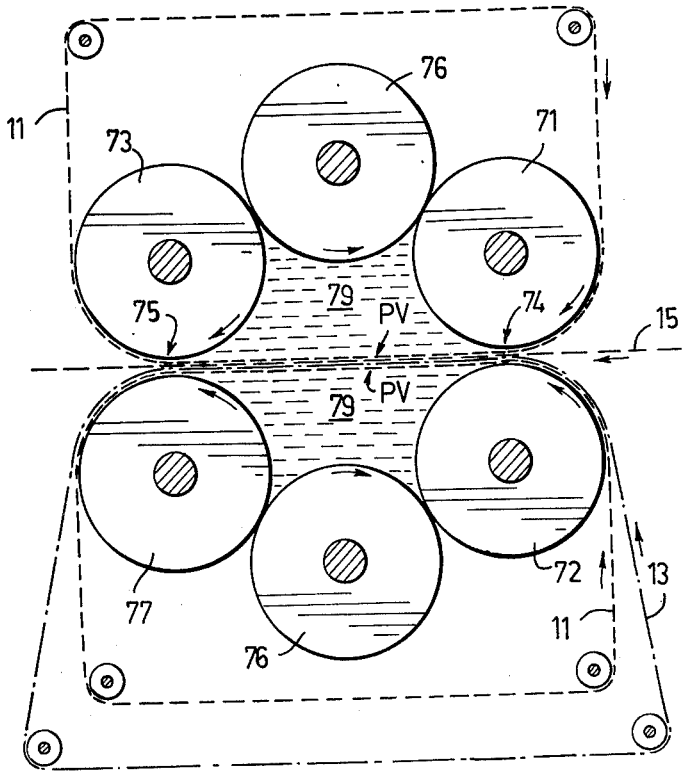

The press shown in FIG. 7 forms two press nips 74,75 but the nips are formed by two separate pairs of rolls, i.e. by the rolls 71,72 and 73,77 respectively. The bands, the web and the felt pass directly from one nip to the other. Between those rolls of each pair which are positioned on the same side of the web there are provided seal rolls 76. Chambers 79 positioned on both sides of the bands are defined by the rolls, serve as pressure medium chambers, so that there are two press zones PV affecting the web. The seal rolls 76 may be replaced by seal beams, as described with reference to FIGS. 3 and 4.

The sealing arrangement shown in FIG. 8 differs from the embodiment according to FIG. 5 in that the sealing takes place also against the end surface 1*a* of the press roll 1. A platelike gable 81 of the gable wall 10' supports a seal holder 82. Seals 83,85 provided in the holder are pressed against the end surfaces 1*a* and 3*a* of press rolls 1 and 3 respectively by means of loading elements 84,86.

The drawings and the description only visualize the idea of the invention. In details the press according to the invention can vary considerably within the scope of the claims.

What we claim is:

1. An extended nip press for a paper machine for removing liquid from a fiber web passing through the press, the press comprising a first press roll, two second press rolls which engage the first press roll to define two nips, at least one felt which passes through the two nips and is entrained about the periphery of the first roll between the two nips, for conveying the web to be treated through the nips, a pressure-transmitting band which also passes through the nips and is entrained about the periphery of the first roll between the two nips with the felt being disposed between the band and the first roll, and a sealing means arranged between said second rolls for forming a sealed pressure medium chamber which, in use, contains a pressure medium to which the pressure-transmitting band is impermeable and which is limited in the machine direction by the part of the band which is entrained about the periphery of the first roll between the two nips, and also by the second rolls and the sealing means, whereby the web is subjected to the pressure of the pressure medium as it passes between the two nips.

2. A press as claimed in claim 1, wherein the sealing means is formed by at least one seal roll arranged parallel to the press rolls in rolling engagement with the peripheries of said second rolls.

3. A press as claimed in claim 2, wherein the seal roll is a further press roll which defines two further nips with the second press rolls respectively, and wherein the band passes through all four nips defined by the press rolls.

4. A press as claimed in claim 3, wherein on passing through the nip defined by the first roll and one of the second rolls, the band is entrained about the periphery of said one of the second rolls and passes through the further nips defined between the further press roll and said second rolls, being entrained about the periphery of said further press roll between said further nips, and wherein a further felt is entrained about the periphery of the further press roll between the further nips with the further felt being disposed between the band and the further press roll, the web, in use, being conveyed with the band about the periphery of said one of the second rolls, and through said further nips with the web disposed between the band and said further felt, whereby the web is subjected to the pressure medium as it passes between said further nips.

5. A press as claimed in claim 1, wherein the sealing means comprises a seal beam arranged parallel to the press rolls and provided with edge seals which are in sliding engagement with the peripheries of said second rolls.

6. A press as claimed in claim 1, wherein said one felt is entrained about the periphery of the first roll in passing to and from the pressure medium chamber, and the band is entrained about the peripheries of the second press rolls respectively when passing to and from the pressure medium chamber, and wherein the press further comprises a second felt which passes through the two nips and is entrained about the periphery of the first roll between the two nips and is entrained about the peripheries of the two second rolls respectively when passing to and from the pressure medium chamber, said second felt being disposed between said band and said one felt when passing through the pressure medium chamber, whereby the web may be disposed between the two felts as it passes between the two nips.

7. A press as claimed in claim 1, wherein the band has two main surfaces of which one confronts the first roll as the band passes between the two nips and of which the other confronts the second rolls, and said other main surface of the band has flat edge regions, and wherein the pressure medium chamber is limited in the transverse direction of the machine by gable walls which are provided with sealing strips pressing against the end surfaces of the second press rolls, the edge region of said other main surface of the band, and the end surface of the sealing means.

8. A press as claimed in claim 1, wherein the pressure medium chamber is limited in the transverse direction of the machine by gable walls which press against the end surfaces of the first and second press rolls and against the end surfaces of the sealing means.

9. An extended nip press for a paper machine for removing liquid from a fiber web passing through the press, the press comprising two first press rolls, two second press rolls which engage the first press rolls respectively to define two nips, a felt which passes through the nips for conveying the web to be treated through the nips, first and second pressure-transmitting bands which pass through the nips with the felt disposed between the first and second bands, first sealing means arranged between said first rolls for forming a first sealed pressure medium chamber which, in use, contains a pressure medium to which the first pressure-transmitting band is impermeable and which is limited in the machine direction by the part of the first band which is between the two nips, and also by the first rolls and the first sealing means, and second sealing means arranged between said second rolls for forming a second sealed pressure medium chamber, located on the opposite side of the bands from the first sealed pressure medium chamber, which, in use, contains a pressure medium to which the second band is impermeable and is limited in the machine direction by the part of the second band which is between the two nips, and also by the second rolls and the second sealing means.

10. A press as claimed in claim 9, wherein the first sealing means comprises a seal roll arranged parallel to the press rolls in rolling engagement with the peripheries of said first rolls.

11. A press as claimed in claim 9 or 10, wherein the second sealing means comprises a seal roll arranged parallel to the press rolls in rolling engagement with the peripheries of said second rolls.

12. A press as claimed in claim 9, wherein the first sealing means comprises a seal beam arranged parallel to the press rolls and provided with edge seals which are in sliding contact with the peripheries of said first rolls, and the second seal means comprises a seal beam arranged parallel to the press rolls and provided with edge seals which are in sliding contact with the perpheries of the second rolls.

* * * * *